US009789614B2

(12) United States Patent
Lee

(10) Patent No.: US 9,789,614 B2
(45) Date of Patent: Oct. 17, 2017

(54) PAIR OF SCISSORS

(71) Applicant: Ching-Lu Lee, Changhua (TW)

(72) Inventor: Ching-Lu Lee, Changhua (TW)

( * ) Notice: Subject to any disclaimer, the term of this patent is extended or adjusted under 35 U.S.C. 154(b) by 27 days.

(21) Appl. No.: 14/989,872

(22) Filed: Jan. 7, 2016

(65) Prior Publication Data

US 2017/0197321 A1 Jul. 13, 2017

(51) Int. Cl.
*B26B 13/28* (2006.01)

(52) U.S. Cl.
CPC ..... *B26B 13/28* (2013.01)

(58) Field of Classification Search
CPC ..... B26B 13/28; A01G 3/02
See application file for complete search history.

(56) References Cited

U.S. PATENT DOCUMENTS 4,341,016 A * 7/1982 Harrison ..... A01G 3/02 30/262
5,297,343 A * 3/1994 Melter ..... B26B 29/04 30/143
5,628,115 A * 5/1997 Hebert ..... B25B 7/06 30/261
6,336,272 B1 * 1/2002 Lee ..... B26B 13/16 30/261
8,079,150 B2 * 12/2011 Huang ..... A01G 3/02 30/254
8,109,003 B2 * 2/2012 Liu ..... A01G 3/02 30/236
9,003,667 B2 * 4/2015 Huang ..... A01G 3/02 30/254
9,415,485 B2 * 8/2016 Steele ..... B25B 7/02
2006/0191142 A1 * 8/2006 Jou ..... B26B 13/16 30/262
2009/0151170 A1 * 6/2009 Lee ..... A01G 3/02 30/252
2009/0320300 A1 * 12/2009 Liu ..... A01G 3/02 30/262
2017/0197321 A1 * 7/2017 Lee ..... B26B 13/28

FOREIGN PATENT DOCUMENTS

FR 2 674 916 * 10/1992
JP 2013-252290 * 12/2013

OTHER PUBLICATIONS

English translation of FR 2 674 916, Oct. 1992.*
English translation of JP 2013-252290, Dec. 2013.*

* cited by examiner

*Primary Examiner* — Hwei C Payer
(74) *Attorney, Agent, or Firm* — Huffman Law Group, PC

(57) ABSTRACT

A pair of scissors has two handles, two blades, and a pivot assembly. The handles are connected with each other and respectively have a pivotal hole. The blades are pivotally connected with each other, are connected respectively with the handles, and respectively have a pivotal hole. The pivot assembly is mounted in the pivotal holes in the handles and the blades to pivotally connect the handles and the blades with each other and has a pivotal rod. The pivotal rod has two pivotal segments. Each pivotal segment has a cross section. One of the pivotal segments has a non-circular cross section and the other pivotal segment has a circular cross section. The pivotal holes in the handles and the blades are same in shape as the cross section of the pivotal segments respectively.

6 Claims, 8 Drawing Sheets

PAIR OF SCISSORS

BACKGROUND OF THE INVENTION

1. Field of the Invention

The present invention relates to a pair of scissors, and more particularly to a pair of scissors that can be assembled conveniently.

2. Description of Related Art

A pair of scissors is applied to cut objects and substantially comprises two blades, two handles, a spring, a pivot assembly, and a locking device. The blades and the handles are pivotally connected with each other at a same pivotal point. Each one of the blades and the handles has a pivotal hole defined therein. The pivotal holes in the blades and the handles are circular in shape. The spring is mounted between the handles. The pivot assembly comprises a threaded rod and a nut. The threaded rod is mounted through the pivotal holes in the blades and the handles and is screwed with the nut. However, the pivot assembly comprising the threaded rod and the nut is not aesthetic in the appearance of the scissors. In addition, because the pivotal holes in the blades and the handles are all circular in shape, the threaded rod mounted through the circular pivotal holes is easily rotated or axially moved relative to the pivotal holes, while the pivot assembly is assembled with the blades and the handles. Therefore, the conventional pair of scissors is inconvenient in assembling.

The locking device substantially comprises two rails and a locking block. The locking block is slidably mounted between the rails and has a locking portion formed on one side of the locking block and selectively engaged with an engaging portion formed on one of the rails. However, because the locking block has only one single engaging portion, to assemble the locking block onto the rails in a specific position and direction is necessary. Consequently, to assemble the locking block onto the rail is inconvenient. In addition, the engaging portion has to be precisely positioned on one of the rails has for being engaged with the locking block, such that this will cause difficulty in precisely manufacturing the scissors.

To overcome the shortcomings, the present invention tends to provide a pair of scissors to mitigate or obviate the aforementioned problems.

SUMMARY OF THE INVENTION

The main objective of the invention is to provide a pair of scissors that can be easily and conveniently assembled.

The pair of scissors has two handles, two blades, a spring, and a pivot assembly. The handles are pivotally connected with each other and are defined respectively as a first handle and a second handle. Each handle has an inner face facing to the inner face of the other handle, a post formed on the inner face, and a pivotal hole. The pivotal hole in the first handle is defined as the first pivotal hole, and the pivotal hole in the second handle is defined as the second pivotal hole. The blades are pivotally connected with each other, are connected respectively with the handles, and are respectively defined as a first blade and a second blade. Each blade has a pivotal hole. The pivotal hole in the first blade is defined as the first pivotal hole, and the pivotal hole in the second blade is defined as the second pivotal hole. The spring is mounted between the handles and has two ends mounted respectively around the posts on the handles. The pivot assembly is mounted in the pivotal holes in the handles and the blades to pivotally connect the handles and the blades with each other and has a pivotal rod and a securing bolt. The pivotal rod has a threaded hole and two pivotal segments. The threaded hole is defined in an end of the pivotal rod. The pivotal segments are respectively defined as a first pivotal segment and a second pivotal segment. Each pivotal segment has a cross section and a section area. One of the pivotal segments has a non-circular cross section and the other pivotal segment has a circular cross section. The section area of first pivotal segment is equal to or larger than the section area of the second pivotal segment. The first pivotal segment is mounted in the first pivotal holes in the first handle and the first blade, and the cross section of the first pivotal segment is same in shape as the first pivotal holes in the first handle and the first blade. The second pivotal segment is mounted in the second pivotal holes in the second handle and the second blade, and the cross section of the second pivotal segment is same in shape as the second pivotal holes in the second handle and the second blade. The securing bolt is screwed into the threaded hole in the pivotal rod.

Other objects, advantages and novel features of the invention will become more apparent from the following detailed description when taken in conjunction with the accompanying drawings.

DETAILED DESCRIPTION OF PREFERRED EMBODIMENT

Figure 1:
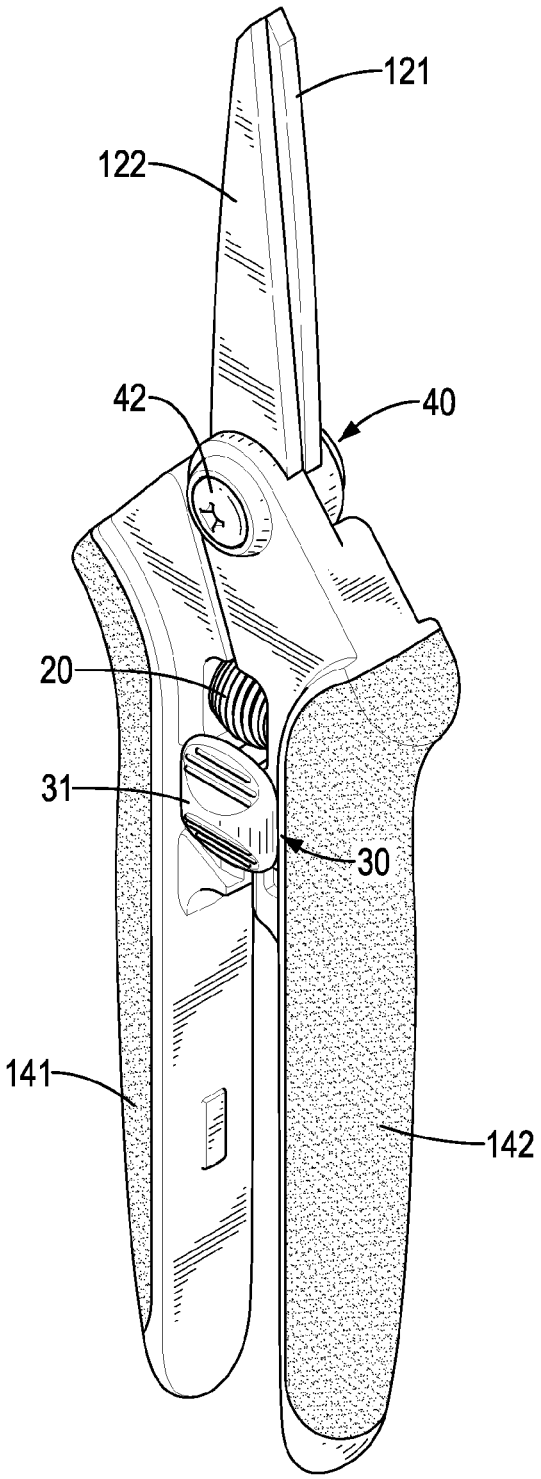
FIG. 1 is a perspective view of a first embodiment of a pair of scissors in accordance with the present invention.
Figure 2A:
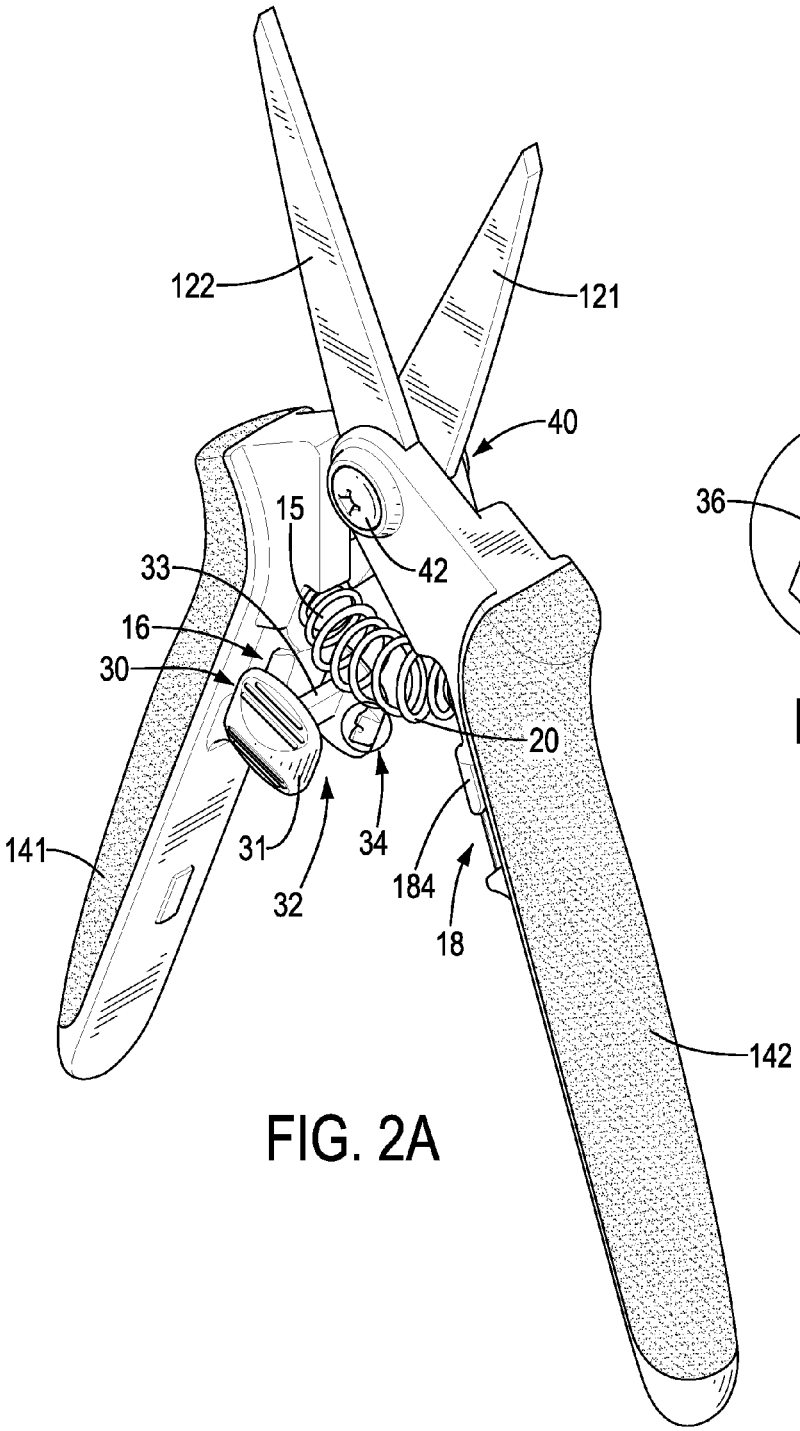
FIG. 2A is another perspective view of the scissors in FIG. 1 showing the scissor is in a for-use condition.
Figure 2B:
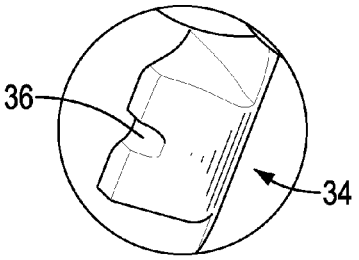
FIG. 2B is an enlarged perspective view of an engaging protrusion of the scissor in FIG. 2A.
Figure 3:
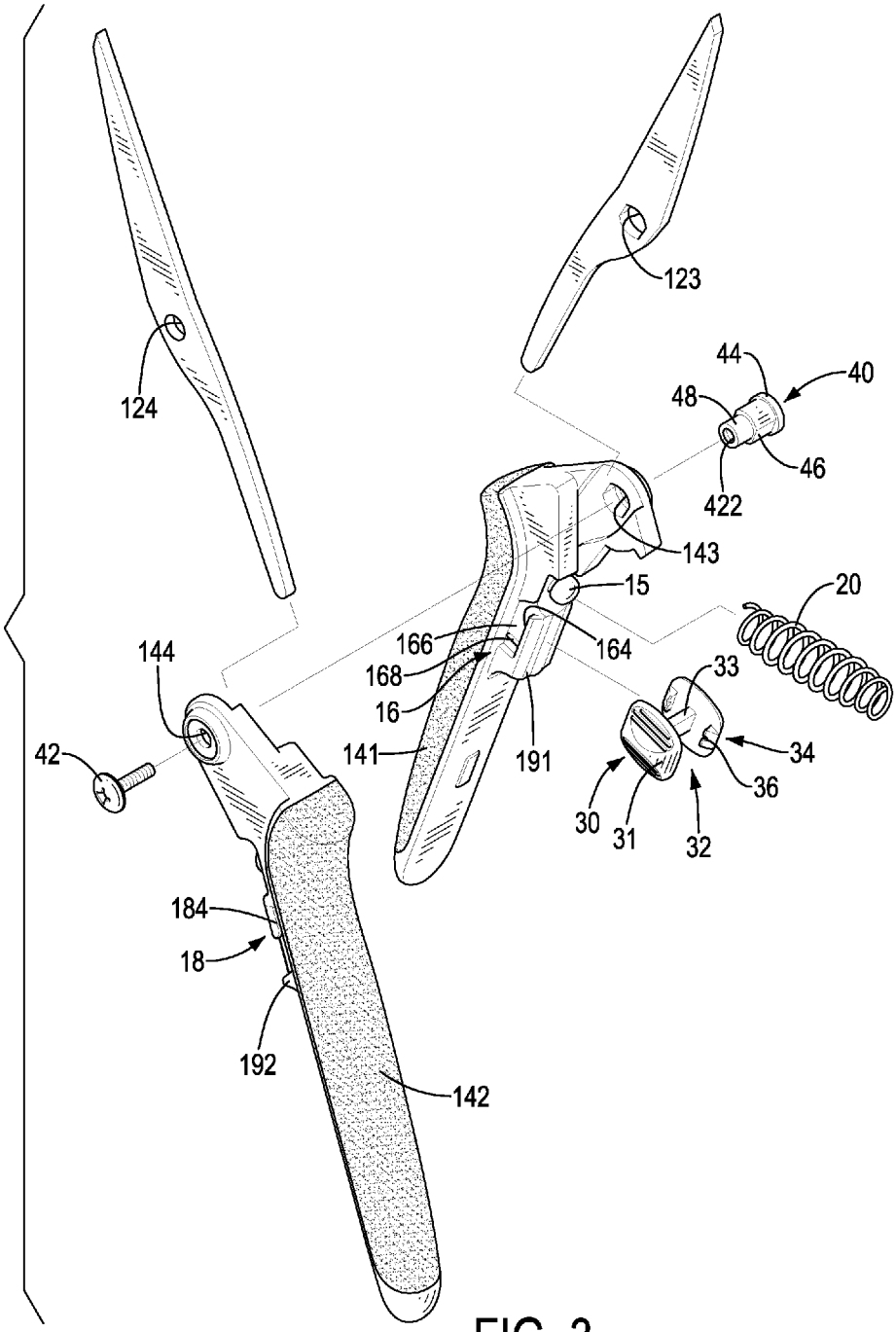
FIG. 3 is an exploded perspective view of the scissors in FIG. 1.
Figure 4:
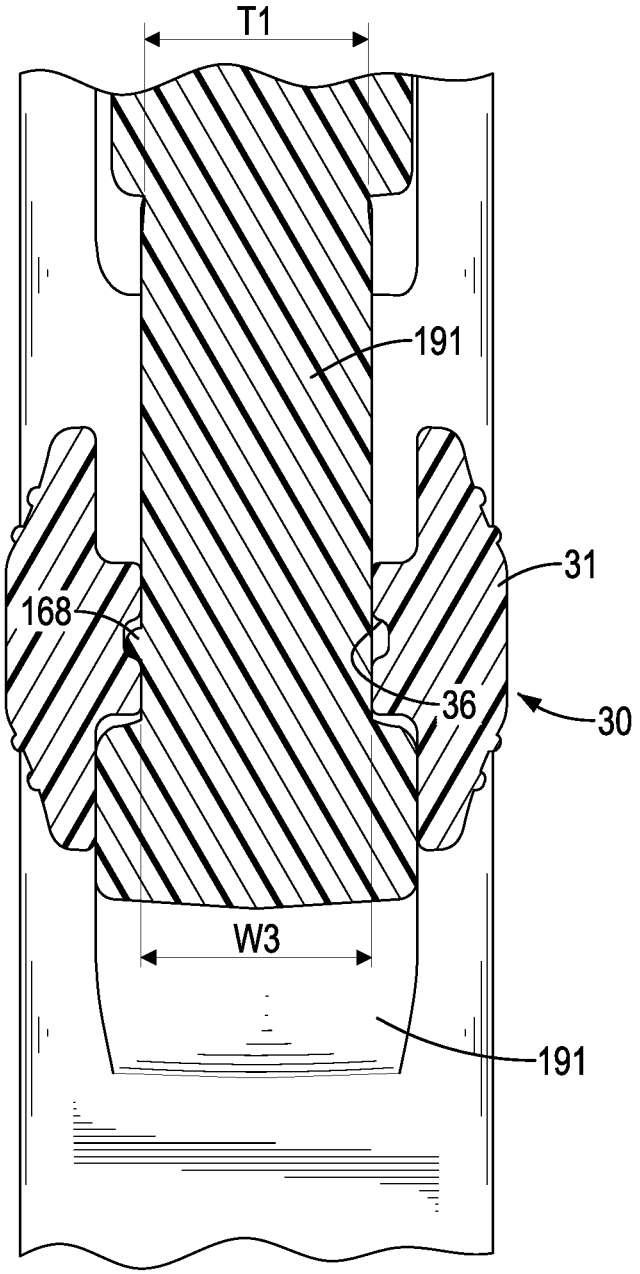
FIG. 4 is an enlarged cross sectional side view of the locking device of the scissors in FIG. 1.

With reference to FIGS. 1 to 5, a pair of scissors in accordance with the present invention comprises two handles 141,142, two blades 121,122, a spring 20, a pivot assembly 40, and a locking device.

The handles 141,142 are pivotally connected with each other and are defined respectively as a first handle 141 and a second handle 142. Each handle 141,142 has an inner face, a post 15, and a pivotal hole 143,144. The inner face of the handle 141 faces to the inner face of the other handle 142. The post 15 is formed on the inner face. The pivotal hole 143 in the first handle 141 is defined as the first pivotal hole 143, and the pivotal hole 144 in the second handle 142 is defined as the second pivotal hole 144.

The blades 121,122 are pivotally connected with each other, are connected respectively with the handles 141,142, and are respectively defined as a first blade 121 and a second blade 122. Each blade 121,122 has a pivotal hole 123,124. The pivotal hole 123 in the first blade 121 is defined as the first pivotal hole 123, and the pivotal hole 124 in the second blade 122 is defined as the second pivotal hole 124.

The spring 20 is mounted between the handles 141,142 and has two ends mounted respectively around the posts 15 on the handles 141,142.

The pivot assembly 40 is mounted in the pivotal holes 123,124,143,144 in the blades 121,122 and the handles 141,142 to pivotally connect the handles 141,142 and the blades 121,122 with each other and comprises a pivot rod 44 and a securing bolt 42.

The pivotal rod 44 has a threaded hole 422 and two pivotal segments 46,48. The threaded hole 422 is defined in an end of the pivotal rod 44. The pivotal segments 46,48 are respectively defined as a first pivotal segment 46 and a second pivotal segment 48. Each pivotal segment 46,48 has a cross section and a section area. One of the pivotal segments 46 has a non-circular cross section and the other pivotal segment 48 has a circular cross section. In the first embodiment, the first pivotal segment 46 is a stub having two flat surfaces formed on the stub. The second pivotal segment 48 is cylindrical and is round in cross section. The section area of the first pivotal segment 46 is equal to or larger than the section area of the second pivotal segment 48. The first pivotal segment 46 is mounted in the first pivotal holes 123,143 in the first blade 121 and the first handle 141, and the cross section of the first pivotal segment 46 is same in shape as the first pivotal holes 123,143 in the first blade 121 and the first handle 141. The second pivotal segment 48 is mounted in the second pivotal holes 124,144 in the second blade 122 and the second handle 142, and the cross section of the second pivotal segment 48 is same in shape as the second pivotal holes 124,144 in the second blade 122 and the second handle 142. The securing bolt 42 is screwed into the threaded hole 422 in the pivotal rod 44.

To pivotally connect the blades 121,122 and the handles 141,142, the first pivotal segment 46 of the pivot rod 44 is inserted into the first pivotal holes 123,143 in the first blade 121 and the first handle 141. Because the shapes of the cross section of the first pivotal segment 46 and the first pivotal holes 123,143 of the first blade 121 and the first handle 141 are same as each other and non-circular, the pivotal rod 44 is kept from being rotatable and axially moveable relative to the first pivotal holes 123,143 of the first blade 121 and the first handle 141. Then, the second pivotal holes 124,144 of the second blade 122 and the second handle 142 are disposed around the second pivotal segment 48 of the pivotal rod 44. The securing bolt 42 is screwed with the threaded hole 422 in the pivotal rod 44, such that the handles 141,142 and the blades 121,122 are pivotally connected with each other at a pivotal point. Because the pivotal rod 44 is kept from being rotatable and axially moveable relative to the handles 141, 142 and the blades 121,122, to assemble the scissors is easy and convenient.

The locking device is mounted on the handles and comprises a first rail 16, a second rail 18, and a locking block 30. The first rail 16 is mounted on the inner face of the first handle 141 and comprises a first rail block 191, two first abutting ribs 164, and an engaging rib 168. The first rail block 191 is formed on the inner face of the first handle 141 and has two opposite sides. The first abutting ribs 164 are formed respectively on the opposite sides of the first rail block 191 to define two assembling gaps 166 respectively between the first abutting ribs 164 and the first handle 141. Each assembling gap 166 has an open end, a closed end, and an assembling entrance 161. The open end is close to the first blade 121, and the closed end is away from the first blade 121. The assembling entrance 161 is formed in the open end of the assembling gap 166 and is inclined relative to the assembling gap 166. The engaging rib 168 is formed on one of the opposite sides of the first rail block 191 at a position adjacent to the closed end of a corresponding one of the assembling gaps 166. Alternatively, with reference to FIG. 8, the first rail block 191 may further have another one engaging rib 168 to make the first rail 16 have two engaging ribs 168 formed respectively on the opposite sides of the first rail block 191. The two engaging ribs 168 are at an equal distance from the closed end of a corresponding one of the assembling gaps 166.

The second rail 18 is mounted on the inner face of the second handle 142 and comprises a second rail block 192 and two second abutting ribs 184. The second rail block 192 is formed on the inner face of the second handle 142 and has two opposite sides. The second abutting ribs 184 are formed respectively on the opposite sides of the second rail block 192 to define two receiving gaps 186 respectively between the second abutting ribs 184 and the second handle 142. Each receiving gap 186 has a closed end, an open end, and a receiving entrance 181. The closed end is close to the second blade 122, and the open end is away from the second blade 122. The receiving entrance 181 is defined in the open end and has a width W1 larger than a width W2 of the receiving gap 186. The receiving entrance 181 is inclined relative to the receiving gap 186 and has a slope larger than a slope of the assembling entrance 161 of each assembling gap 166.

Figure 8:
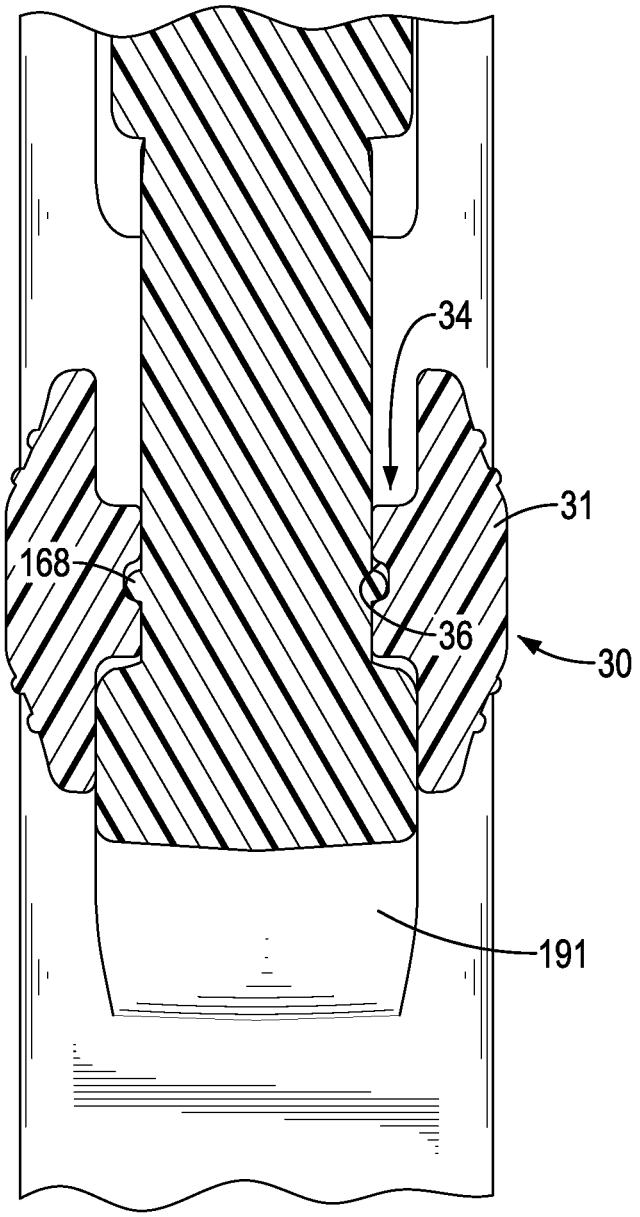
FIG. 8 is a cross sectional side view of an alternative embodiment of a locking device of a pair of scissors in accordance with the present invention.

The locking block 30 is detachably and slidably mounted on the first rail 16 and the second rail 18 and comprises a connecting rib 33, two pushing tabs 31, and two pairs of engaging protrusions 34. The connecting rib 33 has two ends, and the pushing tabs 31 are formed respectively on the two ends of the connecting rib 33 and respectively have a face facing each other. The two pairs of engaging protrusions 34 are formed respectively on the faces of the pushing tabs 31. Each pair of the engaging protrusions 34 includes two engaging protrusions 34 respectively formed on the faces of the pushing tabs 31. One pair of the engaging protrusions 34 abuts the first abutting ribs 164 and is slidably mounted in the assembling gaps 166, and the other pair of the engaging protrusions 34 abuts the second abutting ribs 184 and is slidably mounted in the receiving gaps 186. Preferably, the width W1 of each receiving entrance 181 is larger than the length L1 of each engaging protrusion 34. Two assembling mouths 32 are defined respectively in the two pairs of the engaging protrusions 34. Each assembling mouth 32 has a width W3 larger than a thickness T1 of each one of the first rail block 191 and the second rail block 192. Each engaging protrusion 34 has an engaging dimple 36 formed in the engaging protrusion 34. The engaging rib 168 on the first rail 16 is selectively engaged with the engaging dimple 36 in one of the engaging protrusions 34. In the alternative embodiment as shown in FIG. 8, the two engaging ribs 168 are selectively engaged with the engaging dimples 36 in the engaging protrusions 34 of one of the two pairs of the engaging protrusion 34.

Figure 5:
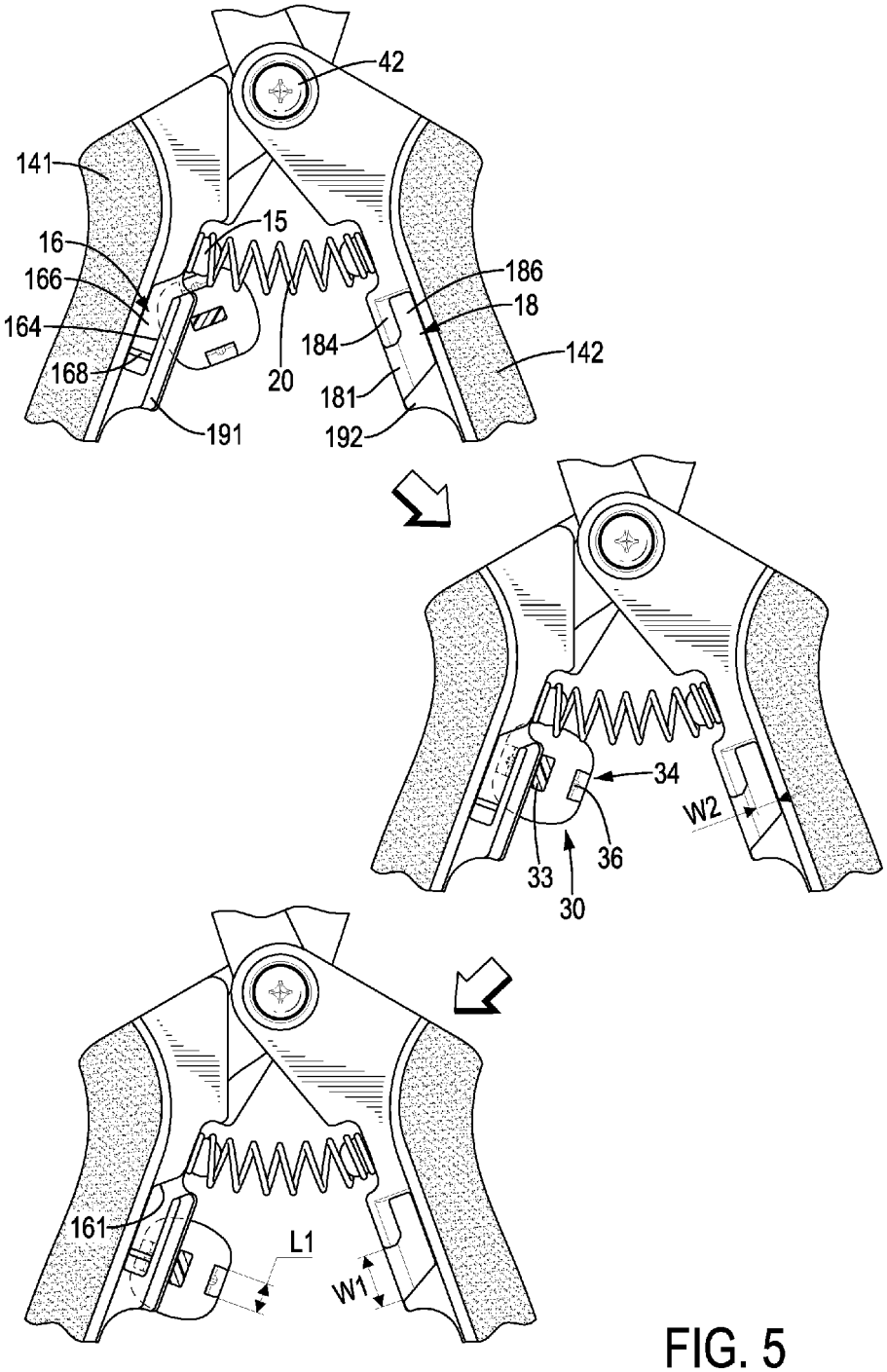
FIG. 5 shows operational front views of the scissors in FIG. 1 showing the process of the locking block being assembled on the first rail.
Figure 6:
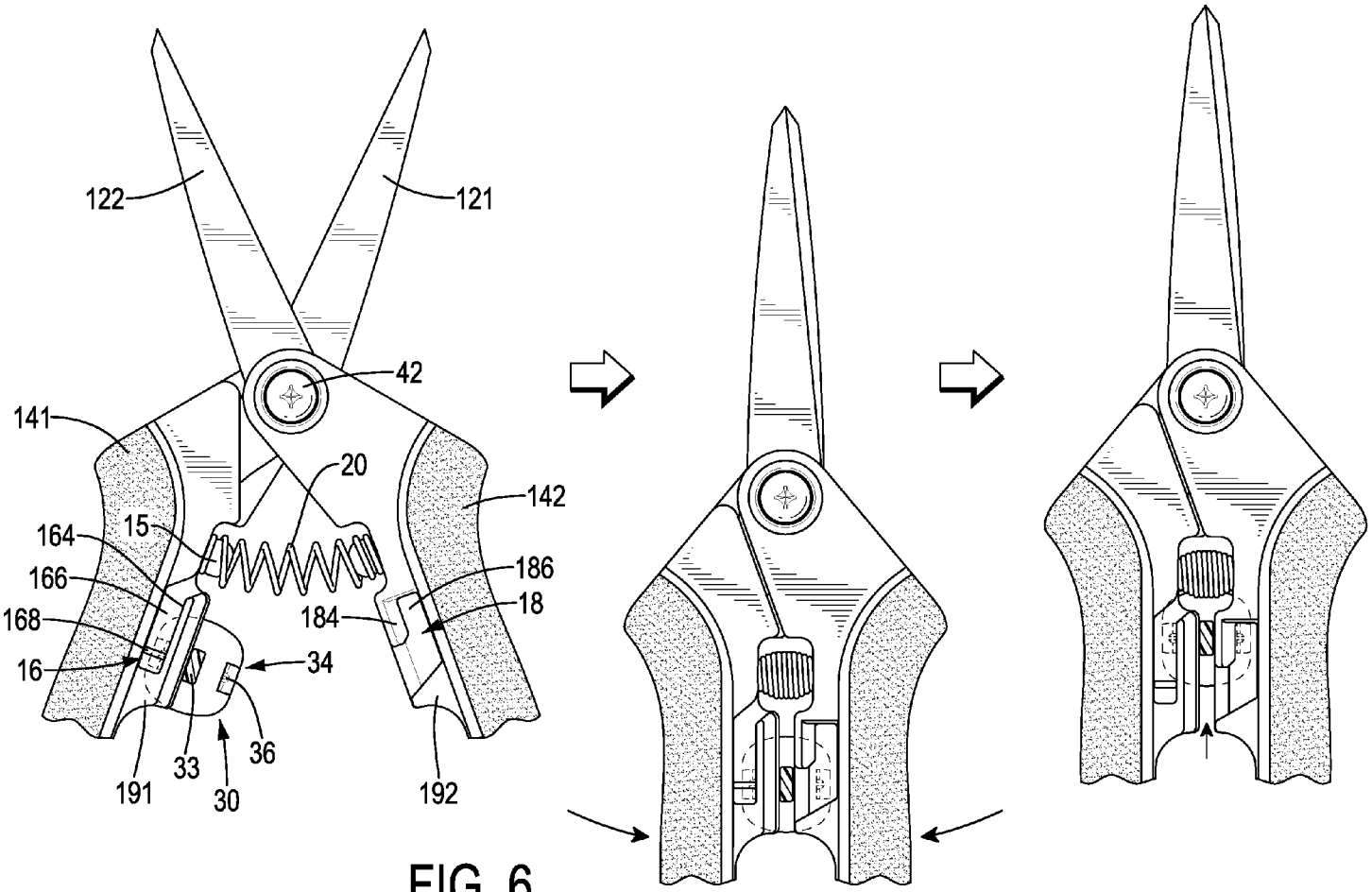
FIG. 6 shows operational front views of the scissors in FIG. 1 showing the process of the locking block being assembled on the second rail.

With reference to FIGS. 5 and 6, to assemble the locking block 30 onto the rails 16,18 on the handles 141,142, the locking block 30 is inclined to enable one pair of the engaging protrusions 34 to be inserted into the assembling gaps 166 along the inclined assembling entrances 161. After said pair of the engaging protrusions 34 enters into the assembling gaps 166, the locking block 30 is slightly rotated to make said pair of the engaging protrusion 34 substantially parallel with the assembling gaps 166. The locking block 30 is then moved along the assembling gaps 166 toward the closed ends of the assembling gaps 166 until the engaging dimple 36 of one engaging protrusion 34 of said pair of the engaging protrusions 34 engages with the engaging rib 168. The handles 141,142 are then pivotally rotated to be close to each other until the other pair of the engaging protrusions 34 on the locking block 30 enters the receiving entrances 181 in the second rail 18. Because the widths W1 of the receiving entrances 181 are larger than the lengths L1 of the engaging protrusions 34, the engaging protrusions 34 can enter the receiving gaps 186 via the receiving entrance 181 without interference. Finally, the locking block 30 can be moved along the assembling gaps 166 and the receiving gaps 186 toward the blades 121,122. Accordingly, the handles 141, 142 and the blades 121,122 will be kept at a locked condition with the abutments between the engaging protrusions 34 and the abutting ribs 164,184.

To unlock the scissors, the locking block 30 is moved along the rails 16,18 to be away from the blades 121,122 until the engaging dimple 36 of one of the engaging protrusions 34 of the pair of the engaging protrusions 34 corresponding to the first rail 16 engages respectively with the engaging rib 168 on the first rail 16. At this time, the other pair of the engaging protrusions 34 corresponding to the second rail 18 corresponds in position to the receiving entrances 181. Consequently, the second handle 142 can be pushed to pivotally rotate relative to the first handle 141 by the force provided by the spring 20, and the engaging protrusions 34 corresponding to the second rail 18 will be disengaged from the second rail 18 via the receiving entrances 181. Accordingly, the pair of scissors is in a for-use condition and can be applied to cut objects.

With the inclined assembling entrances 161, the pair of the engaging protrusions 34 on the locking block 30 can be smoothly inserted into the assembling gaps 166 along the inclined assembling entrances 161 without aligning the engaging protrusions 34 with the assembling entrances 161 deliberately. When the other pair of the engaging protrusions 34 enters the receiving gaps 186 via the inclined receiving entrances 181, the locking block 30 can be automatically rotated to be parallel with the assembling gaps 166 and the receiving gaps 186 by the inclined receiving entrances 181. Accordingly, the engaging protrusions 34 can actually abut the abutting ribs 164,184 on the rails 16,18.

In addition, all of the engaging protrusions 34 on the locking block 30 respectively have an engaging dimple 36 for engaging with the engaging rib 168 on the first rail 16. Thus, the locking block 30 can be assembled onto the rails 16,18 in any direction, such that to attach the locking block 30 onto the rails 16,18 is convenient.

Figure 7:
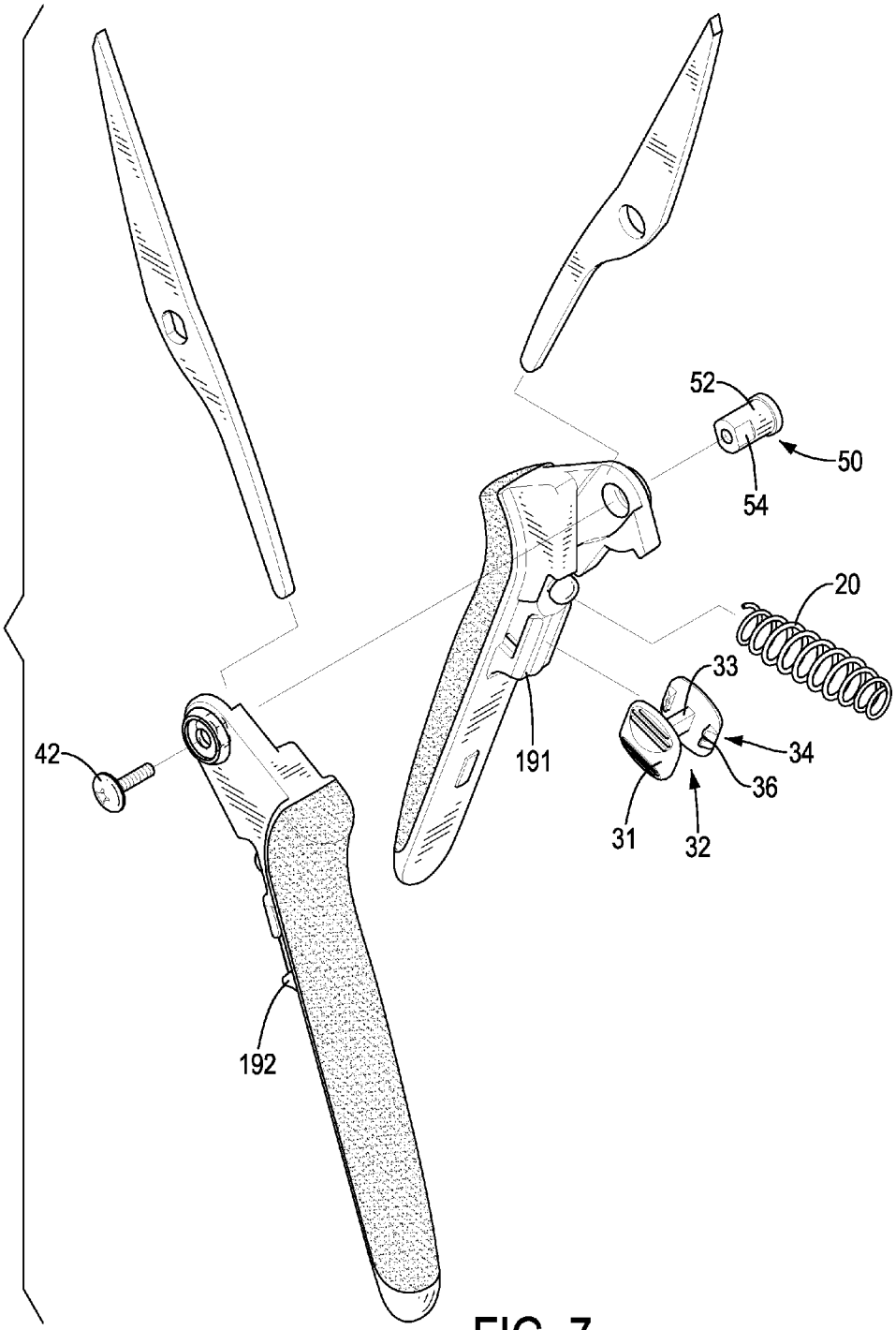
FIG. 7 is an exploded perspective view of a second embodiment of a pair of scissors in accordance with the present invention.

With reference to FIG. 7, in the second embodiment, the first pivotal segment 52 of the pivotal rod 50 is cylindrical and is round in cross section, and the second pivotal segment 54 is a stub having two flat surfaces formed on the stub. The section area of first pivotal segment 52 is larger than the section area of the second pivotal segment 54.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A pair of scissors comprising:

two handles pivotally connected with each other and defined respectively as a first handle and a second handle, and each handle having an inner face facing to the inner face of the other handle;

a post formed on each inner face;

a pivotal hole, wherein the pivotal hole in the first handle is defined as a first pivotal hole, and the pivotal hole in the second handle is defined as a second pivotal hole;

two blades pivotally connected with each other, connected respectively with the handles, and respectively defined as a first blade and a second blade, and each blade having a pivotal hole, wherein the pivotal hole in the first blade is defined as a first pivotal hole, and the pivotal hole in the second blade is defined as a second pivotal hole;

a spring mounted between the handles and having two ends mounted respectively around the posts on the handles;

a pivot assembly mounted in the pivotal holes in the handles and the blades to pivotally connect the handles and the blades with each other and comprising a pivotal rod having a threaded hole defined in an end of the pivotal rod; and two pivotal segments respectively defined as a first pivotal segment and a second pivotal segment, each pivotal segment having a cross section and a section area, wherein one of the pivotal segments has a non-circular cross section and the other pivotal segment has a circular cross section;

the section area of the first pivotal segment is equal to or larger than the section area of the second pivotal segment;

the first pivotal segment is mounted in the first pivotal holes in the first handle and the first blade, and the cross section of the first pivotal segment is same in shape as the first pivotal holes in the first handle and the first blade; and the second pivotal segment is mounted in the second pivotal holes in the second handle and the second blade, and the cross section of the second pivotal segment is same in shape as the second pivotal holes in the second handle and the second blade; and a securing bolt screwed into the threaded hole in the pivotal rod; and a locking device mounted on the handles and comprising a first rail mounted on the inner face of the first handle and comprising a first rail block formed on the inner face of the first handle and having two opposite sides;

two first abutting ribs formed respectively on the opposite sides of the first rail block to define two assembling gaps respectively between the first abutting ribs and the first handle, wherein each assembling gap has an open end close to the first blade and a closed end away from the first blade; and an engaging rib formed on one of the opposite sides of the first rail block at a position adjacent to the closed end of a corresponding one of the assembling gaps;

a second rail mounted on the inner face of the second handle and comprising a second rail block formed on the inner face of the second handle and having two opposite sides;

two second abutting ribs formed respectively on the opposite sides of the second rail block to define two receiving gaps respectively between the second abutting ribs and the second handle, wherein each receiving gap has a closed end close to the second blade and an open end away from the second blade to define a receiving entrance in the open end of the receiving gap, wherein the receiving entrance of each receiving gap has a width larger than a width of the receiving gap; and a locking block detachably and slidably mounted on the first rail and the second rail and comprising a connecting rib having two ends;

two pushing tabs formed respectively on the two ends of the connecting rib and respectively having a face facing each other;

two pairs of engaging protrusions formed respectively on the faces of the pushing tabs, and each pair of the engaging protrusions including two engaging protrusions respectively formed on the faces of the pushing tabs, wherein one pair of the engaging protrusions abuts the first abutting ribs and is slidably mounted in the assembling gaps, and the other pair of the engaging protrusions abuts with the second abutting ribs and is slidably mounted in the receiving gaps;

two assembling mouths are defined respectively in the two pairs of the engaging protrusions;

each assembling mouth has a width larger than a thickness of each one of the first rail block and the second rail block;

each engaging protrusion has an engaging dimple formed in the engaging protrusion; and the engaging rib on the first rail is selectively engaged with the engaging dimple in one of the engaging protrusions.

2. The pair of scissors as claimed in claim 1, wherein the first pivotal segment is a stub having two flat surfaces formed on the stub;

the second pivotal segment is cylindrical and is round in cross section; and the section area of the first pivotal segment is larger than the section area of the second pivotal segment.

3. The pair of scissors as claimed in claim 1, wherein the first pivotal segment is cylindrical and is round in cross section;

the second pivotal segment is a stub having two flat surfaces formed on the stub; and the section area of the first pivotal segment is larger than the section area of the second pivotal segment.

4. The pair of scissors as claimed in claim 1, wherein the first rail further has another engaging rib to make the first rail have two engaging ribs formed respectively on the opposite sides of the first rail block;

the two engaging ribs are at an equal distance from the closed end of a corresponding one of the assembling gaps; and the two engaging ribs of the first rail are respectively engaged with the dimples in the two engaging protrusions of one of the two pairs of the engaging protrusions.

5. The pair of scissors as claimed in claim 4, wherein each assembling gap has an assembling entrance formed in the open end of the assembling gap and inclined relative to the assembling gap;

the receiving entrance of each receiving gap is inclined relative to the receiving gap and has a slope larger than a slope of the assembling entrance of each assembling gap; and the width of each receiving entrance is larger than the length of each engaging protrusion.

6. The pair of scissors as claimed in claim 1, wherein each assembling gap has an assembling entrance formed in the open end of the assembling gap and inclined relative to the assembling gap;

the receiving entrance of each receiving gap is inclined relative to the receiving gap and has a slope larger than a slope of the assembling entrance of each assembling gap; and the width of each receiving entrance is larger than the length of each engaging protrusion.

* * * * *